US009064503B2

(12) United States Patent
Dickins et al.

(10) Patent No.: US 9,064,503 B2
(45) Date of Patent: Jun. 23, 2015

(54) HIERARCHICAL ACTIVE VOICE DETECTION

(71) Applicant: Dolby Laboratories Licensing Corporation, San Francisco, CA (US)

(72) Inventors: Glenn N. Dickins, Como (AU); Timothy J. Neal, West Ryde (AU); Yen-Liang Shue, Kensington (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/386,304

(22) PCT Filed: Mar. 21, 2013

(86) PCT No.: PCT/US2013/033358

§ 371 (c)(1),
(2) Date: Sep. 18, 2014

(87) PCT Pub. No.: WO2013/142723

PCT Pub. Date: Sep. 26, 2013

(65) Prior Publication Data

US 2015/0051906 A1 Feb. 19, 2015

Related U.S. Application Data

(60) Provisional application No. 61/614,562, filed on Mar. 23, 2012.

(51) Int. Cl.
*G10L 25/78* (2013.01)
*G10L 19/16* (2013.01)

(52) U.S. Cl.
CPC ..... *G10L 25/78* (2013.01); *G10L 19/173* (2013.01); *G10L 2025/786* (2013.01)

(58) Field of Classification Search
USPC ..... 704/214–215
See application file for complete search history.

(56) References Cited

U.S. PATENT DOCUMENTS 5,737,408 A 4/1998 Hasegawa
5,983,183 A 11/1999 Tabet (Continued)

FOREIGN PATENT DOCUMENTS

WO 02/080147 10/2002
WO 2011/042502 4/2011

OTHER PUBLICATIONS

Bruhn, S. et al. "Continuous and Discontinuous Power Reduced Transmission of Speech Inactivity for the GSM System" Global Telecommunications Conference, 1998.

(Continued)

*Primary Examiner* — Douglas Godbold

(57) ABSTRACT

One or more audio signals are processed using a multi-stage (hierarchical) voice and/or signal activity detector (VAD/SAD). A first stage is capable of reducing the workload bandwidth by employing an inexpensive VAD/SAD processor. One or more subsequent stages may further process the audio signals from the first stage. Other implementations may include a first stage that also performs continuity preservation between last blocks of audio signal and the first blocks of audio after it is detected that relevant audio signals are resumed. In yet other implementations, the first stage may extract features from audio signals when they are presented in their coded domain, and possibly with little or no decoding of the audio signal.

21 Claims, 5 Drawing Sheets

(56) References Cited

U.S. PATENT DOCUMENTS

| | | | |
|---|---|---|---|
| 6,397,179 | B2 | 5/2002 | Crespo |
| 6,507,653 | B1 | 1/2003 | Romesburg |
| 6,708,147 | B2 | 3/2004 | Mekuria |
| 7,269,252 | B2 | 9/2007 | Eran |
| 7,313,519 | B2 | 12/2007 | Crockett |
| 7,359,855 | B2 | 4/2008 | Patel |
| 7,457,757 | B1 | 11/2008 | McNeill |
| 7,609,646 | B1 | 10/2009 | Qi |
| 7,660,712 | B2 | 2/2010 | Gao |
| 7,769,585 | B2 | 8/2010 | Wahab |
| 7,804,817 | B1 | 9/2010 | Peshkin |
| 7,917,356 | B2 | 3/2011 | Chen |
| 8,260,607 | B2 | 9/2012 | Villemoes |
| 8,280,731 | B2 | 10/2012 | Yu |
| 8,538,763 | B2 | 9/2013 | Yu |
| 8,554,556 | B2 | 10/2013 | Yu |
| 8,560,320 | B2 | 10/2013 | Yu |
| 8,583,426 | B2 | 11/2013 | Yu |
| 8,705,749 | B2 | 4/2014 | McGrath |
| 8,712,076 | B2 | 4/2014 | Dickins |
| 2002/0116186 | A1 | 8/2002 | Strauss |
| 2003/0088622 | A1 | 5/2003 | Hwang |
| 2003/0112966 | A1 | 6/2003 | Halder |
| 2008/0306736 | A1 | 12/2008 | Sanyal |
| 2009/0125305 | A1 | 5/2009 | Cho |
| 2010/0004928 | A1* | 1/2010 | Yonekubo et al. ..... 704/233 |
| 2010/0260273 | A1 | 10/2010 | Raifel |
| 2011/0035213 | A1* | 2/2011 | Malenovsky et al. ..... 704/208 |
| 2011/0206198 | A1 | 8/2011 | Freedman |
| 2011/0243127 | A1 | 10/2011 | Li |
| 2013/0054236 | A1* | 2/2013 | Garcia Martinez et al. .. 704/233 |
| 2014/0126745 | A1 | 5/2014 | Dickins |

OTHER PUBLICATIONS

Sugiyam, A. et al "Noise Suppression with Synthesis Windowing and Pseudo Noise Injection" IEEE International Conference on Acoustics, Speech and Signal Processing, May 2002.

Whitmal, N.A. et al. "Wavelet-based Noise Reduction" International Conference on Acoustics, Speech and Signal Processing, May 1995.

S.G. Sankaran "Implementation and Evaluation of Echo Cancellation Algorithms" Virginia Polytechnic Institute, Blacksburg, VA, Nov. 1996.

Benyassine, A. et al "ITU-T Recommendation G.729 Annex B: A Silence Compression Scheme for Use with G.729 Optimized for V.70 Digital Simultaneous Voice and Data Applications" IEEE Communications Magazine, IEEE Service Center, Piscataway, US, vol. 35, No. 9, Sep. 1, 1997, pp. 64-73.

* cited by examiner

HIERARCHICAL ACTIVE VOICE DETECTION

CROSS-REFERENCE TO RELATED APPLICATIONS

This application claims the benefit of priority to U.S. Provisional Patent Application Ser. No. 61/614,562 filed on 23 Mar. 2012, hereby incorporated by reference in its entirety.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD OF THE INVENTION

The present invention relates to audio systems and, more particularly, to audio systems having hierarchical audio processing.

BACKGROUND OF THE INVENTION

It is known to employ Voice or Signal Activity Detectors (VADs/SADs) to improve audio quality and bandwidth in audio or voice communications. For example, the following, co-owned patent applications describe such subject matter: (1) United States Patent Publication Number 20110106533 to Yu, published 5 May 2011 and entitled "MULTI-MICROPHONE VOICE ACTIVITY DETECTOR"; (2) United States Patent Publication Number 20100198593 to Yu, published 5 Aug. 2010 and entitled "SPEECH ENHANCEMENT WITH NOISE LEVEL ESTIMATION ADJUSTMENT"; (3) United States Patent Publication Number 20100211388 to Yu et al., published 19 Aug. 2010 and entitled "SPEECH ENHANCEMENT WITH VOICE CLARITY"; (4) United States Patent Publication Number 20100076769 to Yu, published 25 Mar. 2010 and entitled "SPEECH ENHANCEMENT EMPLOYING A PERCEPTUAL MODEL"; (5) U.S. Pat. No. 8,280,731 to Yu, granted 2 Oct. 2012 and entitled "NOISE VARIANCE ESTIMATOR FOR SPEECH ENHANCEMENT"—all of which are hereby incorporated by reference in their entirety.

In addition, it is known to convert a plurality of audio input signals form a first format to another format. For example, the following co-owned patent applications describe such subject matter: (1) United States Patent Publication Number 20110137662 to McGrath et al., published 9 Jun. 2011 and entitled "AUDIO SIGNAL TRANSFORMATTING"; (2) U.S. Pat. No. 8,260,607 to Villemoes et al., granted 4 Sep. 2012 and entitled "AUDIO SIGNAL ENCODING OR DECODING"; (3) International Patent Application No. PCT/US2012/024370 filed on 8 Feb. 2012, entitled "COMBINED SUPPRESSION OF NOISE AND OUT-OF-LOCATION SIGNALS" and International Patent Application No. PCT/US2012/024372 filed on 8 Feb. 2012 entitled "POST-PROCESSING INCLUDING MEDIAN FILTERING OF NOISE SUPPRESSION GAINS"—all of which are hereby incorporated by reference in their entirety.

SUMMARY OF THE INVENTION

Several embodiments of audio processing systems and methods of their manufacture and use are herein disclosed.

In one embodiment, a system for processing at least one audio signal, e.g., from a conference call setting, is presented. In one embodiment, a multi-stage system is described that comprises a first stage processor which inputs audio signals from one or a plurality of audio sources and such audio sources may be of different audio encodings. The first stage is capable of reducing the workload bandwidth of the various input audio sources, and possibly with an inexpensive VAD/SAD processor. A second and/or subsequent stage may perform further processing of the audio signals from the first stage.

Other embodiments may include a first stage that also performs continuity preservation between last blocks of audio signal and the first blocks of audio after it is detected that relevant audio signals are resumed.

In yet other embodiments, the first stage may extract features from audio signals when they are presented in their coded domain, and possibly with little or no decoding of the audio signal.

Other features and advantages of the present system are presented below in the Detailed Description when read in connection with the drawings presented within this application.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION OF THE INVENTION

Figure 1:
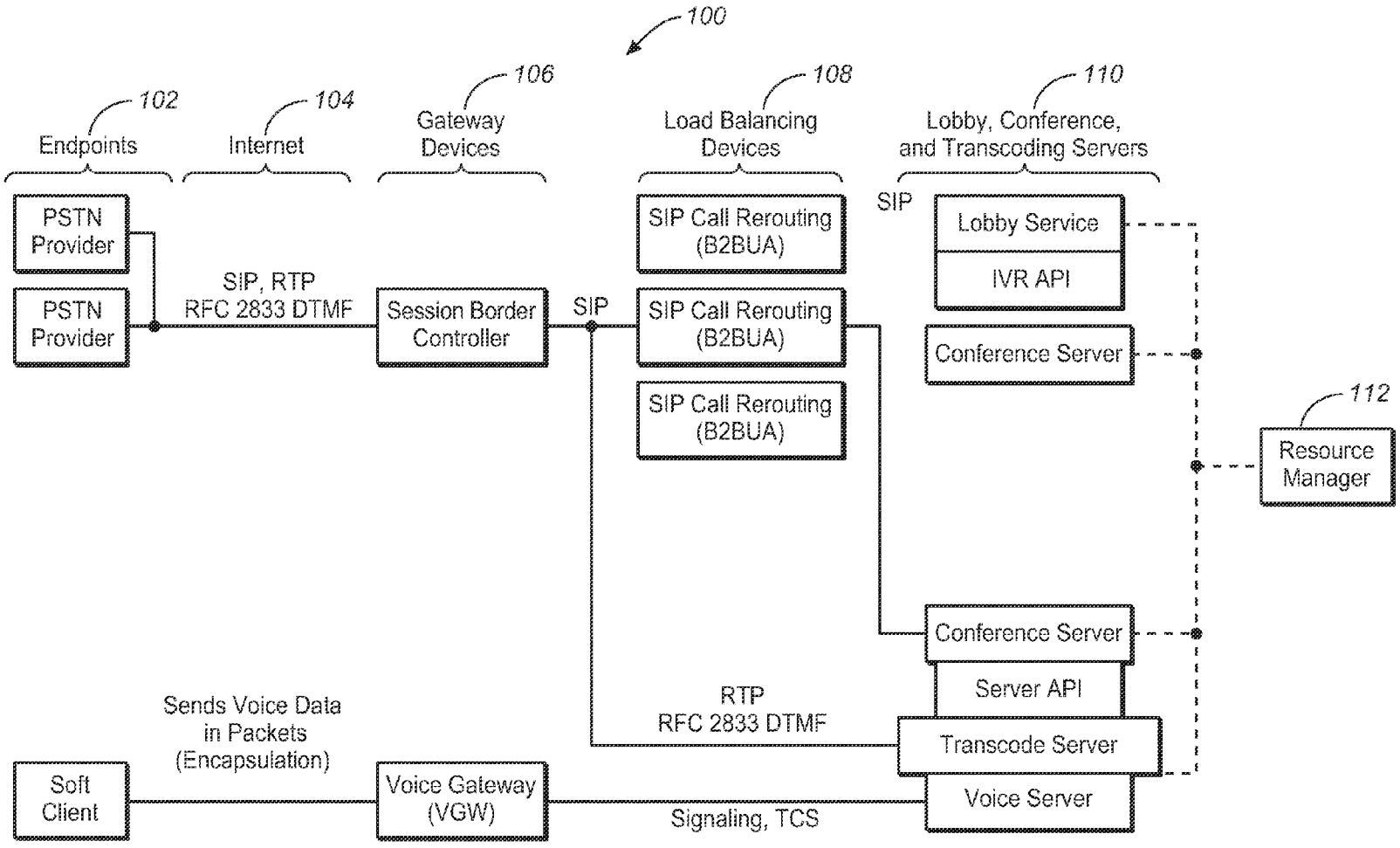
FIG. 1 depicts a typical environment and architecture of a voice conferencing system.

As utilized herein, terms "component," "system," "interface," and the like are intended to refer to a computer-related entity, either hardware, software (e.g., in execution), and/or firmware. For example, a component can be a process running on a processor, a processor, an object, an executable, a program, and/or a computer. By way of illustration, both an application running on a server and the server can be a component. One or more components can reside within a process and a component can be localized on one computer and/or distributed between two or more computers. A component may also be intended to refer to a communications-related entity, either hardware, software (e.g., in execution), and/or firmware and may further comprise sufficient wired or wireless hardware to affect communications.

Throughout the following description, specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Introduction

Within a voice conferencing system, there is often a system component that is responsible for the steps of: (1) decoding incoming voice streams encoded with various codecs to a common format for system operation and (2) encoding the mixed streams for delivery back to the client. For the purpose of this application, this component will be called a 'transcoder'. For a transcoder, it may be desirable to manage complexity—as well as maintain reasonable latency through this decoding and/or encoding process. To accomplish these tasks, many embodiments of the present application are presented that decrease the workload of a transcoder (or parts thereof) that deal with many incoming audio streams with potentially different formats. Many embodiments of the present system comprise a plurality of staged VADs on the multiple inputs coming from other audio and/or voice systems.

In one embodiment, a first stage may be provided that is designed to be of very low complexity, but high sensitivity. The first stage may be designed to eliminate at least some of the incoming signal for further consideration. In practice, and particularly for large conferences, many of the participants are silent for much of the conference, and thus this approach may achieve a significant reduction in processing load and in the bandwidth comprising the audio signal from a number of different audio sources to be sent to second or subsequent stages of processing.

In other embodiments, a second stage may be provided that comprises a more accurate estimation of the periods of speech or signal activity than perhaps is resident in a first stage. In addition, the second stage may comprise other processing capabilities, such as noise reduction, echo suppression, intelligibility enhancement, leveling and other components to achieve voice consistency or a particular property or properties expected or managed in the subsequent conferencing system.

In many embodiments, such multi-staged processing systems may achieve suitable performance, audio quality, sensitivity and specificity. In addition, other embodiments are provided that avoid potential discontinuities in the audio stream as may be seen by the second stage, to avoid problems with audio quality and parameter estimation.

FIG. 1 depicts the typical environment and architecture of a voice conferencing system. Unless the system design is "fully closed" (i.e. all endpoints 102 are controlled and of the same standard and format), it may be desirable to handle incoming and outgoing traffic (possible via the Internet 104 or some other communications pathway) from other parties' systems. In order to permit this, the system may change the encoding format and perform appropriate preprocessing to achieve a level of consistency in the incoming voice streams, and perhaps appropriately render and convert the outgoing voice streams to suit the capability of the target endpoints. The system that performs this function is typically referred to as a gateway (106) or a transcoder.

A voice gateway is generally located close to the conference server 110 (and any load balancing devices 108) and hosted in some dedicated computing facility and services—e.g. resource manager 112. Since the gateway may manage many ports or voice channels, it may be desirable to minimize the amount of processing for each stream to achieve scalability. One embodiment of the present system sets out an effective approach to reducing the processing on the input streams. For example, one embodiment affects an approach where the scalability may be achieved further upstream on the incoming voice streams—e.g., at the point where they first enter the proprietary conferencing system. In some embodiments, these techniques may be combined with approaches for controlling the overall system load, using prioritization in the conference server to cull a conference group to the most significant or important streams. Where there are a large number of participants calling in from legacy or alternate systems (e.g. PSTN or other VoIP systems), these embodiments offer a computational and cost advantage at the server location.

In these and other embodiments, systems and methods are provided for application in the area of voice processing and large scale conferencing communications systems. In particular, several embodiments relate to complexity reduction in a system that may deal with incoming audio streams or voice channels from external systems and alternate formats, to bring them into the transform domain, signal format, timing, preprocessed and associated meta-data required by a voice conferencing system—e.g., possibly as part of a transcoder, bridge or other part of the voice processing system.

Multi-Staged Embodiments

In one embodiment, a staged (or hierarchical) approach is employed for the detection of signal activity, with a first stage having a much lower complexity and controlling the activation of a second stage. To implement such a multi-staged system, it may be desirable to have one or more of the following: a first stage, accepting at least one or more audio signals of at least one or more audio formats, that (1) affects a low complexity, low latency, sensitive signal activity detector that may be adaptive to the noise and signal properties of the incoming signal at this first stage; (2) achieves at least some attrition or more significant reduction in the number of audio blocks, packets or samples to be further considered by the second stage; and/or (3) affects a low complexity overlap, fade or other continuity preservation to reduce discontinuities in the resultant audio stream that after the deletion of inactive segments is passed to the second stage and should still appear to be reasonably continuous.

In addition, it may be desirable to have one or more of the following: a second and/or later stage that: (1) affects a subsequent preprocessing component of higher complexity than the first stage; (2) affects an additional signal activity detector; (3) implements other processing, such as noise reduction, echo suppression, intelligibility enhancement, leveling and other components to achieve voice consistency or a particular property or properties expected or managed in the subsequent conferencing system. As between the multiple stages, it may be desirable to have a degree of data sharing or co-operation between the two stages to achieve effective operation.

Figure 2:
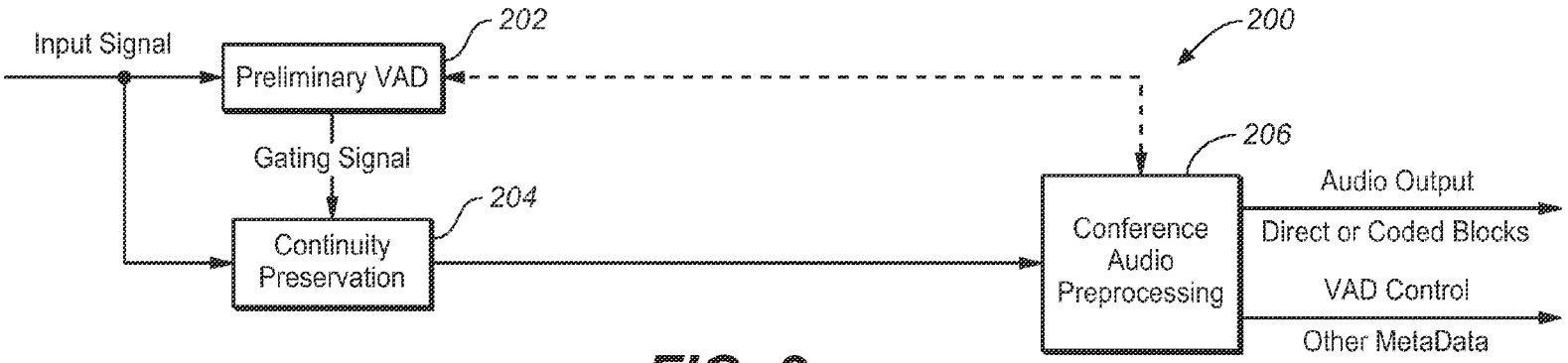
FIG. 2 depicts one embodiment of a multi-staged input audio processing system as made in accordance with the principles of the present application.

FIG. 2 depicts one embodiment of a multi-staged input audio processing system 200 as made in accordance with the principles of the present application. System 200 comprises a first stage module 202 which may further comprise a preliminary VAD (and/or signal activity detector, "SAD"). As will be discussed further herein, an optional continuity preservation module 204 may provide additional processing for a suitable first stage. As shown, an input audio signal (or a plurality of audio signals, possibly from other, disparate systems with various encodings) may be provided to module 202 (and/or module 204). If the first stage comprises only a VAD/SAD, then the output may proceed (as indicated by the dashed line) to a second (or other multiple stage) processing block 206—for further processing, as will be discussed in greater detail below.

If the first stage has processing other than VAD/SAD (e.g. continuity preservation 204), then VAD/SAD 202 may work together (e.g., VAD/SAD sending a gating signal or other control signal) to further processing. From there, audio signals and/or other metadata signals may be passed to second and/or multiple stage processing (as indicated by the solid line from block 204 to block 206—and optionally along the dotted line from block 202 to 206).

From second and/or multiple stage block 206, there may be a number of outputs possible—e.g., audio signal output (in various possible formats, such as direct or coded blocks) and other signals (e.g., VAD control) or metadata, as desired for possible further processing.

Preliminary VAD/SAD

In one embodiment, a suitable first stage may be implemented, as mentioned, as a simple signal activity detector (SAD) and/or voice activity detector (VAD) which may use a broadband root mean square (RMS) measure of the signal energy. Such a preliminary SAD/VAD might detect the signal energy on a block size that matches the block size of the subsequent preprocessing. One possible design might involve a set of tracking parameters which estimate the RMS noise floor and a recent peak level which, along with a predefined sensitivity parameter, may be used to dynamically create a threshold of signal activity. When the incoming RMS first exceeds this threshold, the VAD/SAD may be activated and the signal blocks may begin being passed to the other possible pre-processing.

In some embodiments, the VAD/SAD may affect a "hold-over" (i.e., for example, extending the indication of signal activity for a set time after exceeding the threshold) and/or an increase in sensitivity in some time subsequent to the initial passing of the threshold. Such approaches may be based on the high likelihood of continuous segments of signal activity and are well known to those skilled in the art.

In one embodiment, a possible block size might be 20 ms, with an effective size range of 5 to 80 ms being reasonably. In some embodiments, an additional weighting filter may be applied to the signal prior to calculating the RMS measure with this filter having a larger response in the regions where it may be expected that a voice signal might have a higher signal to noise ratio (SNR). Some examples of such filters include: A weighting, C weighting, and RLB. In other embodiments, a more sophisticated loudness or signal activity measure may be contemplated. Such sophisticated loudness or activity detection may be considered optional as it is desired that the first stage have low complexity. To achieve low complexity, it is generally expected that the first stage avoid the use of a transform or conversion of the signal to some alternate representation (subbands or frequency bins, wavelets etc.).

Figures 3A, 3B, 3C:
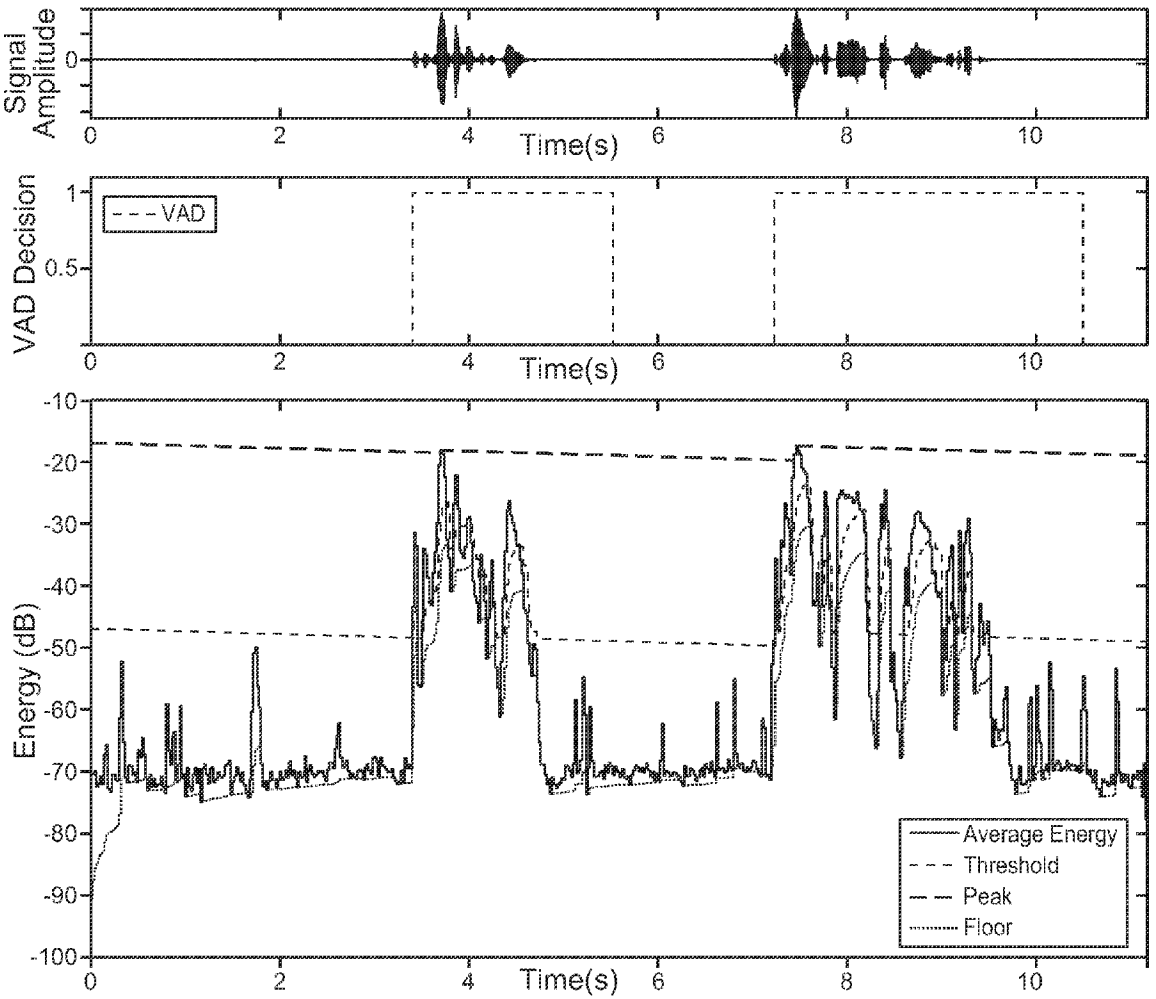
FIGS. 3A through 3C depict the processing of one embodiment of a preliminary VAD/SAD.

FIGS. 3A through 3C depict the processing of one embodiment of a preliminary VAD/SAD. FIG. 3A depicts one possible input signal plotted over time. FIG. 3B depicts one possible set of decisions made by the VAD/SAD in dotted line. The dotted line may represent a pass-through filter over time—in which signals within the dotted lines are passed-through as input and the other parts of the signal may be ignored. FIG. 3C depicts one possible analysis of an input signal that may be made by a VAD/SAD. Input signal (e.g., in solid line) may be calculated for various measures and/or statistics—e.g., floor energy, peak energy, and a threshold energy. Threshold energy may be set by VAD/SAD as the cut-off point below which the signal is not construed as voice or any other relevant signal to be passed-through to output.

Figures 4A, 4B, 4C:
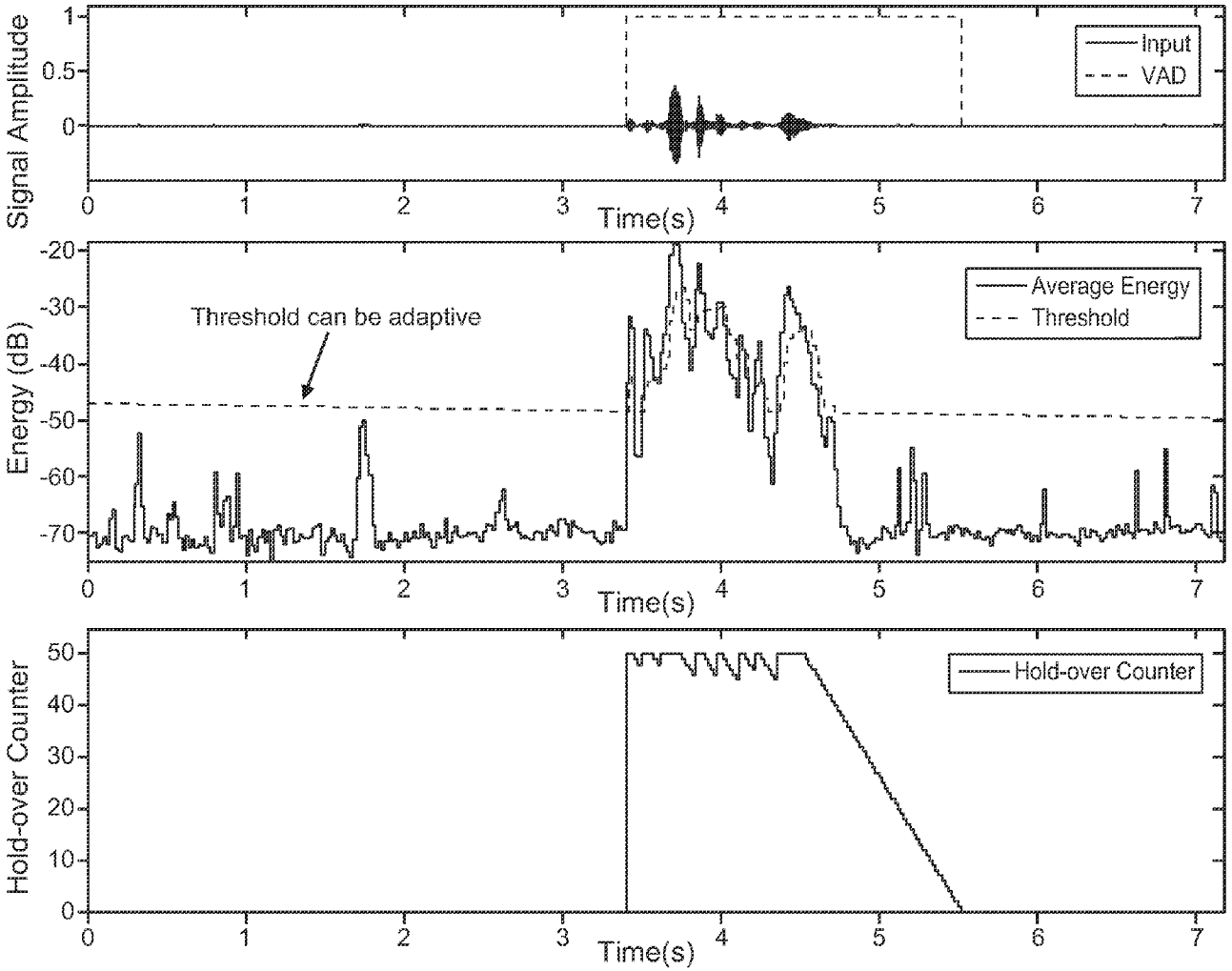
FIGS. 4A through 4C depict one further embodiment of a preliminary VAD/SAD further comprising a hold-over processing block.

FIGS. 4A through 4C depict one further embodiment of a preliminary VAD/SAD further comprising a hold-over processing block. FIG. 4A depicts an input signal plotted over time and a VAD/SAD making one possible decision to admit the signal within the dotted line to proceed as input to further processing.

FIG. 4B depicts a portion of the input signal over time in which a threshold may be applied. If the input signal exceeds this particular threshold then the hold-over counter may be set to a particular value. This hold-over threshold may be dynamically adjusted or otherwise adaptive over time. If the signal falls below this threshold at any given time, then the hold-over counter may start to be decremented. As may be seen between FIGS. 4B and 4C, the hold-over counter may be re-set and decline over several times during the course of a relevant signal. If the signal later subsides and does not exceed the threshold for a sufficiently long period of time, the hold-over counter would continue to decrement and go to zero.

It will be appreciated that the foregoing exhibits some examples and embodiments to provide and to demonstrate the design and operation of the low complexity VAD. It should also be appreciated that there are other possibilities here that may be of low complexity such as G.729e, zero crossing, etc. and their use might suffice for present purposes.

Continuity Preservation

In addition to VAD/SAD, another optional processing block in the first stage (or, as may be implemented in the second stage) may be continuity preservation, e.g., as shown in block 204. This component would be responsible for ensuring a soft transition between the audio which was last sent on to the second layer of pre-processing, and the onset of the audio signal which is again to be processed after the detection of the restart of signal activity.

Continuity preservation may be desirable to ensure the signal is reasonably continuous and plausible at the point that it hits the second stage of processing. In one embodiment, as far as the second stage of processing is concerned, the time gap and deletion of signal between the 'last' block and the buffered block never happened. Thus, any discontinuity here may not be expected and may cause some fault or feature detection that leads to undesirable results or processing in the second stage.

In general, however, the second stage of processing may be in a state of indicating no signal activity prior to the recommencement of signal from the preliminary VAD. This may be ensured through the 'information sharing' where the second stage processing passes control signals to the preliminary stage (e.g., as denoted by the dotted line in FIGS. 2 and 6) to remain open until the secondary stage detects the end of desired signal activity. In response to such control signals from second or subsequent stage processors, the first stage processor may dynamically alter its processing according to such control signals. As such, the second stage may affect a gradual or sufficient fade-in to avoid unwanted discontinuities in the output of the second stage. Therefore, any discontinuity caused by the preliminary VAD and gap in signal to the second stage, in many embodiments, may not be transferred to the final output. Furthermore, the last buffered block and start of the onset block as detected by the first stage is typically at a low level, since the preliminary VAD has detected the end of signal. However, it may still be prudent to avoid the discontinuity, as it may be detected as some glitch or audio problem by the second stage. A short cross fade may be desirable in some embodiments, or when the input is in a coded domain, suitable processing to ensure the change in codec state does not cause problems.

Given the above, in some embodiments, it is feasible to leave out the continuity preservation entirely and accept any minor consequences that result. Thus in some embodiments, the continuity preservation modules for both the time domain and codec domain may be omitted entirely.

Figure 5:
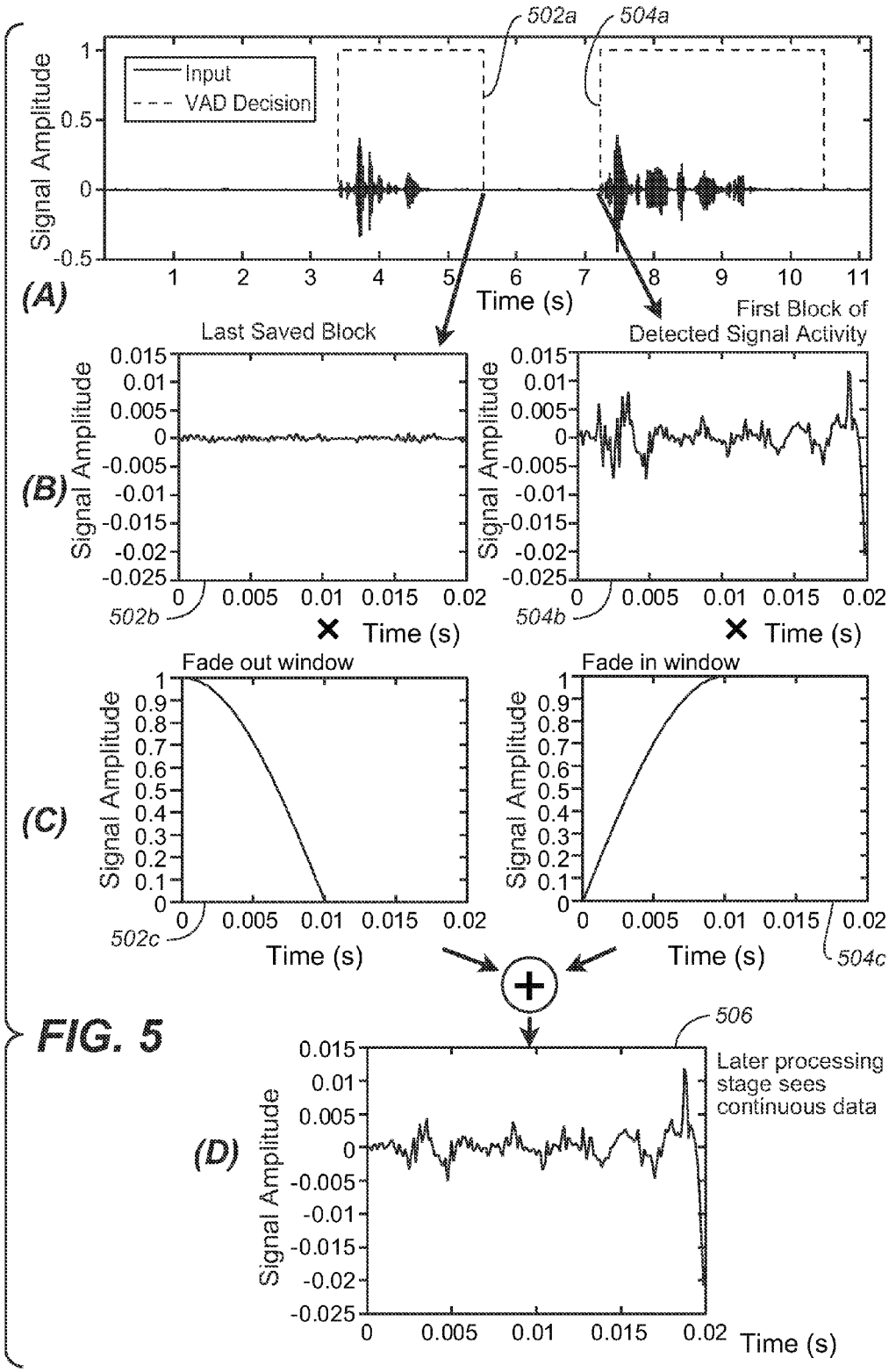
FIGS. 5A through 5D depict the processing of one embodiment for continuity preservation.

In one embodiment, continuity preservation may be implemented in a buffer, where the buffer may retain the audio block following the last block of a given segment identified as signal activity. At the point where a later block is identified as the onset of signal activity, a short cross fade may be applied between the two blocks—e.g., the buffered first block not identified as active, and the first block identified as active later in time. In some embodiments, the cross fade may be achieved with a linear, quadratic, cosine, or other fade as known to those skilled in the art. In one embodiment, the cross fade time may be set to 5 ms, with a possible suitable range of times found to range from lms to the block length. FIGS. 5A through 5D depict the processing of one embodiment for continuity preservation—in particular, FIGS. 5A-5D depict one example of cross fade for continuity preservation. FIG. 5A depicts an input signal, plotted as signal strength or energy vs. time. Input signal is shown as a solid line. One embodiment of a VAD/SAD may be seen as giving a decision (e.g. dotted line) as to whether a voice or other relevant signal is being input. Other inputs may be disregarded outside of that decision.

In FIG. 5A, it may be seen that two blocks 502*a* and 504*a* are considered as relevant. FIG. 5B comprises views of the last saved block 502*b* from 502*a* and the first block 504*b* of detected signal activity in block 504*a*.

FIG. 5C depict embodiments of possible processing that may be applied—a Fade-Out Window 502*c* to block 502*b* and a Fade-In Window 504*c* to block 504*b*. FIG. 5D shows the composite of this processing—to comprise the potential output signal 506. For merely one embodiment, the two components of the preliminary VAD and the continuity preservation may be represented in the following pseudo-code and Matlab code (Copyright Dolby Inc.):

TABLE 1

Preliminary SAD and Continuity Preservation components
Signal Activity Detector and Continuity Preservation

```
For an input block of data:
• Remove DC offsets from the input signal (i.e. with a high pass filter)
• Calculate the average energy, E, of the input block
• Calculate threshold, threshold, based on E
• If E > threshold, set a hold-over counter, GateHold, to the predefined hold time;
  Else, decrement GateHold by 1
    • If GateHold > 0:
    o If preliminary VAD was off (i.e. 0) in the previous block, cross fade the
input block with previously buffered block and set as output
  Else, set input block as output
      o        Set preliminary VAD on (i.e. 1)
  Else, set preliminary VAD off
• If GateHold is 1, i.e. the last block before the preliminary VAD turns off, buffer this
block to be used for cross-fading when signal activity is detected again later.
  Threshold Calculation
  Parameters:
  E - Average energy of input block
  MaxAbsThresh - Absolute maximum of threshold sensitivity
  MinNoiseThresh - Minimum threshold above noise floor
  MaxPeakThresh - Maximum for threshold from peak
  MinAbsThresh - Absolute minimum of threshold sensitivity
    • Calculate the peak value, Peak, as the maximum between E and the previous
peak value scaled by some time constant, Pα.
      Peak = max(E, Pα×E + (1 − Pα)×Peak)
    • Calculate the floor value, Floor, as the minimum between E and the previous
floor value scaled by some time constant, Fα.
      Floor = min(E, Fα×E + (1 − Fα)×Floor
    • Set the threshold as a value between the Floor and Peak while making sure
the value is bounded by MinNoiseThresh and MaxAbsThresh.
      threshold = max(
        max(
          min(Floor*MinNoiseThresh, MaxAbsThresh),
          Peak/MaxPeakThresh
        ),
    MinAbsThresh)
  )
      Matlab
      function VAD = TimeDomainGate(Input, Output)
%%%
```

TABLE 1-continued

Preliminary SAD and Continuity Preservation components
Signal Activity Detector and Continuity Preservation

```
GateHoldN     = GateHoldTime / Block * Fs;
FadeOut       =
(sin((0.5:Block)/FadeTime/Fs*pi/2).*((0.5:Block)<FadeTime*Fs))';
FadeIn     = sqrt( 1 - FadeOut. ^ 2 );
%%%
```

Possible Parameters

In the above pseudo-code embodiment, the calculation of the threshold in the preliminary VAD may involve some parameters which act to constrain the range of the threshold value. The following discussion is meant to be exemplary of the possible parameters which may be desirable in the embodiment outlined above.

The minimum absolute threshold (MinAbsThresh) defines the lowest energy level which may be set as a threshold value. This effectively sets the point below which no signal activity may be detected and is useful for turning off the preliminary VAD—e.g., when only quiet background noise is present. In one embodiment, this value was set to 0.000001 (−60 dB), with suitable range of values found to range from 0.001 to 0.00000001.

The maximum absolute threshold (MaxAbsThresh) defines the highest energy level which may be set as a threshold value. This value prevents sudden spikes in the signal energy level from skewing the threshold calculations. In one embodiment, this value was set to 0.03 (approximately −15 dB), with a suitable value ranging from 0.001 to 0.1.

The maximum peak threshold (MaxPeakThresh) helps to define a potential threshold candidate value which is MaxPeakThresh below the peak, where the peak is a value derived from the average energy. MaxPeakThresh effectively sets the minimum energy level above which an input may be determined to have signal activity. In one embodiment, the maximum peak threshold is set to a value of 1000 (30 dB), with 10 to 10000 being a suitable range of values.

The minimum noise threshold (MinNoiseThresh) helps to define a potential threshold candidate value which is MinNoiseThresh above the floor, where the floor is a value derived from the average energy. If the floor is taken to represent the noise floor, then MinNoiseThresh effectively sets the maximum energy level above which signal activity will be determined to be present. In one embodiment, the minimum noise threshold was set to a value of 5 (approximately 7 dB), with a suitable range of values found to range from 1 to 20.

The peak hold time (PeakHoldTime) specifies the time constant for the peak memory. Effectively, it may control the rate of decay for the peak value. In one embodiment, this value was set to 10 seconds with a suitable range found to range from 1 second to 30 seconds.

The floor hold time (FloorHoldTime) defines the time constant for the floor memory. In one embodiment, this value was set to 2 seconds with 1 second to 20 seconds found to be a suitable range of values.

In one embodiment, the continuity preservation component may comprise two parameters which control its behavior: (1) hold-over time and (2) cross-fade time. The hold-over time (GateHoldTime) determines how long the preliminary VAD should remain on after the last signal activity has been detected. It also specifies which block should be buffered to be used for cross fading when signal activity is detected again. In one embodiment, the hold-over time is set to 1 second, with a suitable range of values found to be ranging from 0.1 second to 10 seconds.

The cross fade time (FadeTime) defines the amount of signal to use for cross fading. In one embodiment, this was set to 10 ms, with a suitable range of times found to range from 1 ms to the block length.

Second Stage and/or Multiple Stage Processing

As noted above, the first stage processing may transform multiple input audio streams and output multiple audio data and/or metadata streams to a second and/or multiple stage processing. In some embodiments, overall system performance may be enhanced by the sharing of information between the first and subsequent stages of processing. For merely exemplars, the following are particular examples that may be of use in some embodiments: (1) using the signal activity from the second stage to make sure the first stage does not terminate the activity detection prematurely; (2) using the second stage to further guide the adaptive thresholds used in the first stage; and/or (3) using the performance of the second stage, or an analysis of the audio coming into the second stage to further control the thresholds of the first stage.

Alternate Embodiments with Feature Extraction

Figure 6:
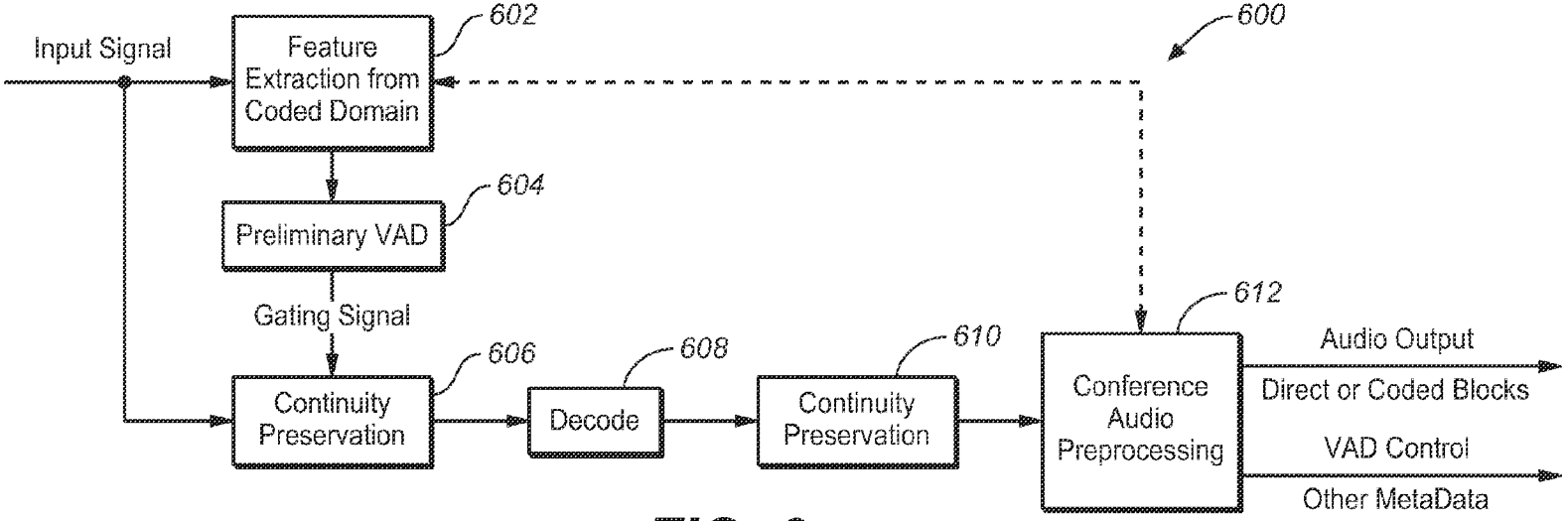
FIG. 6 shows one possible system embodiment comprising feature extraction from a coded domain.

In some embodiments, the incoming audio may not be available in PCM, G.711 or similar uncompressed form. Alternative embodiments may still work in the coded domain using feature extraction. FIG. 6 shows one possible system embodiment (600) comprising feature extraction from a coded domain (602), possibly with low complexity, for preliminary VAD (604) computation. It may then be desirable to ensure continuity (606) in the coded domain prior to decode (608) and/or the alternate audio domain (610) expected at the input to the preprocessing (612).

It should be noted that some feature extraction from the coded domain may be performed without performing the full decode. This may be desirable as it again saves computational load by reducing the number of incoming streams that must be simultaneously decoded.

In some embodiments, use may be made of model based coding parameters such as pitch, LTP, AR, LSP and excitation code. In other embodiments, the use of some component of the encoded stream associated with the signal level may be used, such as exponent values, masking curves, explicit level or gain.

As is depicted in FIG. 6, some embodiments using information from the encoded audio signal for the preliminary VAD may employ two stages of continuity preservation. Where the codec has some amount of state associated with the codec process, it may be desired to perform some operation in the coded domain in order to avoid discontinuity or corrupted signal being generated by the decoder. Solutions for this in some embodiments might include priming, state estimation, coded domain fading and/or padding. The second stage of continuity preservation may operate in the time domain or other domain shared with the Conference Audio Preprocessing.

It should also be noted that in some embodiments, decode 608 may be performed as more of a transcode, in that there may be steps or algorithms that can be used to map the audio signal between the two coded domains (e.g., the external code format and the transform or subbands used by the conference audio processing) without performing a complete decode and encode of the audio signal.

To further elaborate on the possibilities for extraction of features from the coded domain, the following illustrative examples are provided. These are not exhaustive and are provided as guidance and suggestion for some common coding techniques used in specific protocols and signaling common in voice communications over networks. In one embodiment where the signal is provided to the gateway in the form of a set of time samples (e.g., PCM or a variant such as G.711), the feature that is extracted in the main proposed embodiment may be the signal block energy or RMS or weighted RMS measure. In other embodiments, it is possible to directly use the power (MS) or, in some instances, the peak amplitude in each block may be an effective feature.

In some embodiments, a specific coded domain may contain information in the encoded structure that represents similar features. For example, an overall gain or scaling parameter may be present as a normalizing component of the codec structure. Such a feature, if available, may be extracted in the first stages of decoding and used for the preliminary signal detection. In some proprietary codecs or signaling schemes, some representation of the signal block level or energy may be a part of the standard, and therefore may be used without directly decoding the audio frame. A specific example of this, while not directly relevant to the gateway, might be the audio packet format used in the proposed conferencing system which includes a frame loudness measure.

In coding structures based on linear prediction, such as CELP (code excited linear prediction) or ACELP, the encoded audio frame includes some information regarding the scale, excitation code and the LSP (line spectral pair) representation of the audio block spectra. For such coding schemes, the scale, pitch, excitation code and/or spectral characterization maybe used directly or indirectly through various rules and adaptive components to effect a threshold and activity decision in the preliminary stage. Decoding the complete audio frame would involve constructing the excitation code with appropriate pitch and running this through a reconstructed linear predictive filter. By using the features directly in a preliminary VAD this computational effort is avoided in the preliminary gating.

However, due to the state information in such codecs, it may be desired to perform some additional continuity preservation, as the concatenation of two coded blocks that were not initially adjacent, as would occur at the point that the preliminary activity detector returns to a signal active state, may cause a period of instability in any subsequent decoder. A possible embodiment may prime the decoder, for example, by repeating the adjacent packets, and recoding or using a modified procedure to decode the PCM data at the discontinuity.

In another embodiment, where the coding style is a frequency or subband based approach, it may be desirable to first encode an exponent envelop or similar coarse representation of the signal spectra. This may be used to then determine appropriate quantization levels for the frequency bin data. The exponent data may provide a direct indication of spectra, which is associated with the signal level and may be employed in a preliminary detection stage. By only unpacking the exponent, and avoiding the computational load of mantissa bit unpacking, quantized reconstruction, noise fill and transform for a full decode, the preliminary stage may operate effectively and thus gate both the audio decoding load and the conference system preprocessing.

In some embodiments where there is some commonality in block size and transform used in the external format and the proposed conferencing system, it may be possible to affect the conference processing without reverting to a time domain or PCM intermediate at any stage. In such embodiments, the frequency domain representation, obtained from unpacking the exponents and mantissas from the coded bit stream may be passed onto the next stage of processing without an inverse transform. For some combinations of formats across the gateway, it may be possible to convert or largely approximate the frequency domain representation required in the conference processing and coded format using a mapping, interpolation, or convolutional, process.

In some embodiments, the audio streams may be encoded in the conference system format prior to sending to the conference server. In these embodiments, the conference server may not need to manage multiple incoming audio streams, which are then decoded. In some embodiments, the conference server may receive and utilize fully encoded packets by forwarding them to appropriate clients.

Alternate Implementation Strategies

In many of the embodiments described herein, it should be appreciated that the two (or multiple) stages of processing may reside on one processing unit—or on separate processing units. Furthermore, these separate processing units may differ significantly in their nature and realization of programmatic algorithms to affect the desired functionality. In some embodiments, second or a subsequent stage of processing may be more complex than the first stage of processing and, thus, may be better suited to a general purpose or large scale processing unit. For the proposed application, where many of these second stage processing threads may exist, and a large subset of them being idle at any point in time (e.g., affecting the scalability and the result of the proposed invention), this may be managed on a system with flexible processor allocation, threading and memory management. In some embodiments this computational unit may be a physical or virtualized server.

In some embodiments, the primary signal detection stage may operate continuously, subject to the presence of data on the incoming stream. It may also be a less complex detection stage, which in some embodiments may be as simple as a signal energy measure exceeding a fixed threshold. Accordingly, this stage may run on some dedicated signal processing construct, such as FPGA, ASIC, DSP, RISC etc. which may be optimized for speed, cost and/or power consumption. Where the gating may be achieved by signaling control or bits that exist trivially in the data packets for that stream, the detection may even be achieved in some embodiments at the network layer in the routing or low level packet management of the system or network interface. It is also considered, that while different in nature in both processing and continuity, in some embodiments, the primary detection stage may be run on a similar or singularly same computational platform as the secondary stage.

Where the two processing stages are separated or running on substantially different computational platforms or process spaces, and the communication between them for signal data path and shared information may not be realized as simple data or memory sharing, the signaling process between the tiered processing components may be achieved in some embodiments by a network, IP, semaphore, messaging subsystem or other kernel or system transport layer.

In some systems, the gateway and server components are considered as separate products and largely vended by independent companies. As such, there may be some commercial interest in maximizing sales volume, and the typical performance model of a gateway may be as a fixed number of ports that can be simultaneously handled. Generally, it is the features and complexity of the conference audio processing, which is the only tier in such systems that are traded off against the scalability and number of ports. In many embodiments of the present system, the system may be envisaged as a component in a system where the conference server and gateway may be integrated. It may be desirable from the standpoint in the overall resources consumed by the system against a given number of simultaneous ports.

It may also be desirable to be selectively running the conference processing on signal streams when the first low complexity stage detects activity is immediately apparent and may not cannibalize revenue to the commercial venture—e.g., a value proposition may be sold for the full system rather than a fixed function gateway that is sold base on a simple port number metric. Such system is also made possible by the known nature of the conference server which may take significant advantage of discontinuous streams into the system. In other embodiments, the gateway device may actually perform the opposite function of taking a stream that may be discontinuous, and inserting appropriate comfort noise as would an end point suited to the external signaling scheme. In this way, conventional gateways may be compatible and simultaneously lower efficiency.

A detailed description of one or more embodiments of the invention, read along with accompanying figures, that illustrate the principles of the invention has now been given. It is to be appreciated that the invention is described in connection with such embodiments, but the invention is not limited to any embodiment. The scope of the invention is limited only by the claims and the invention encompasses numerous alternatives, modifications and equivalents. Numerous specific details have been set forth in this description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

The invention claimed is:

1. A system for processing audio signals, said system comprising:

a first stage processor, said first stage processor inputting an audio signal from at least one audio source, wherein said first stage processor is capable of performing preliminary voice or signal activity detection (VAD/SAD) processing upon said audio signal and capable of outputting a first intermediate set of audio signals; wherein said first stage processor is capable of eliminating at least some of the audio signal; and a second stage processor, said second stage processor inputting said first intermediate set of audio signals from said first stage processor, wherein said second stage processor is capable of performing audio processing upon said first intermediate set of audio signals; wherein said second stage processor is capable of performing voice or signal activity detection (VAD/SAD) processing upon said first intermediate set of audio signals; wherein an accuracy for estimating periods of speech or signal activity is higher for the second stage processor than for the first stage processor;

wherein said first stage processor is capable of achieving a reduction in bandwidth for the first intermediate set of audio signals which is sent to said second stage processor;

wherein said second stage processor is capable of sending a control signal to said first stage processor and wherein said first stage processor is capable of dynamically changing processing according to said control signal; and wherein said control signal indicates to said first stage processor to remain open until said second stage processor detects the end of desired signal activity.

2. The system as recited in claim 1 wherein said first stage processor is capable of implementing a signal activity detector which has a complexity which is lower than a complexity of the signal activity detector of the second stage processor.

3. The system as recited in claim 2 wherein said simple signal activity detector is capable of detecting the root mean square (RMS) energy of one of said at least one audio signal.

4. The system as recited in claim 3 wherein said signal activity detector is capable of dynamically setting a threshold of RMS energy wherein no signal below said threshold is passed to said second stage processor.

5. The system as recited in claim 4 wherein said first stage processor is capable of implementing a hold-over counter, said hold-over counter capable of extending an indication of signal activity after exceeding said threshold.

6. The system as recited in claim 1 wherein said first stage processor further comprises a continuity preservation module, wherein said continuity preservation module is capable of providing a transition between the audio signal which was last sent to said second stage processor and the onset of the audio signal after detecting the restart of signal activity.

7. The system as recited in claim 6 wherein said continuity preservation module is capable of sending a substantially continuous audio signal from said first stage processor to said second stage processor.

8. The system as recited in claim 6 wherein said continuity preservation module is capable of creating a composite signal from the last saved block of audio signal and said first block of audio signal after detection of a restart of signal activity.

9. The system as recited in claim 8 wherein said composite signal is the sum of said last saved block modulated by a fade-out window signal and said first block modulated by a fade-in window.

10. The system as recited in claim 8 wherein said composite signal is a function of a cross-fade between said last saved block and said first block of audio signal.

11. The system as recited in claim 6 wherein said second stage processor is capable of performing one of a group, said group comprising: using the signal activity from the second stage to make sure the first stage does not terminate the activity detection prematurely, using the second stage to further guide the adaptive thresholds used in the first stage, and using the performance of the second stage to further control the thresholds of the first stage, or an analysis of the audio coming into the second stage to further control the thresholds of the first stage.

12. The system as recited in claim 6 wherein said first stage processor further comprises a feature extraction module, wherein said feature extraction module is capable of extracting features of said audio signal, said audio signal being in a coded domain.

13. The system as recited in claim 12 wherein said features comprise one of a group, said group comprising: pitch, LTP, AR, LSP, excitation code, exponent values, masking curves, explicit level and gain.

14. The system as recited in claim 1 wherein said first stage processor is implemented in a different processor from said second stage processor.

15. A method for processing at least one audio signal, the steps of said method comprising:

inputting at least one audio signal;

performing a first stage VAD/SAD processing on said at least one audio signal to create a first intermediate set of audio signals, wherein said first intermediate set of audio signals comprises less bandwidth than said at least one audio signal;

performing a second stage audio processing on said first intermediate set of audio signals;

wherein said second stage audio processing comprises performing voice or signal activity detection (VAD/SAD) processing upon said first intermediate set of audio signals; wherein an accuracy for estimating periods of speech or signal activity is higher for the second stage audio processing than for the first stage VAD/SAD processing;

sending a control signal from the second stage audio processing to said first stage VAD/SAD processing; and dynamically changing first stage VAD/SAD processing according to said control signal; wherein said control signal indicates to said first stage VAD/SAD processing to remain open until said second stage processor detects the end of desired signal activity.

16. The method as recited in claim 15 wherein a complexity of performing a signal activity detector of the first stage VAD/SAD processing is smaller than a complexity of performing a signal activity detector of the second stage audio processing.

17. The method as recited in claim 16 wherein said step of performing a signal activity detector of the first stage VAD/SAD processing further comprises detecting the RMS energy of one of said at least one audio signal.

18. The method as recited in claim 17 wherein said step of performing a signal activity detector of the first stage VAD/SAD processing further comprises dynamically setting a threshold of RMS energy wherein no signal below said threshold is passed to said second stage audio processing.

19. The method as recited in claim 18 wherein said step of performing a first stage VAD/SAD processing further comprises setting a hold-over counter.

20. The method as recited in claim 15 wherein said step of performing a first stage VAD/SAD processing further comprises performing continuity preservation processing, wherein continuity preservation processing comprises providing a transition between the audio signal which was last sent to said second stage audio processing and the onset of the audio signal after detecting the restart of signal activity.

21. The method as recited in claim 20 wherein said step of performing a first stage VAD/SAD processing further comprises performing feature extraction from said at least one audio signal.

* * * * *